US007118628B2

(12) United States Patent
Taiana et al.

(10) Patent No.: US 7,118,628 B2
(45) Date of Patent: Oct. 10, 2006

(54) METHOD AND APPARATUS FOR COVERING AREAS OF DAMAGED PROTECTIVE COATING, AND A TRANSPORT SYSTEM

(75) Inventors: Peter Taiana, Staffelbach (CH); Andreas Lanz, Bergdietikon (CH)

(73) Assignee: Elpatronic AG, Bergdietikon (CH)

( * ) Notice: Subject to any disclaimer, the term of this patent is extended or adjusted under 35 U.S.C. 154(b) by 0 days.

(21) Appl. No.: 10/622,887

(22) Filed: Jul. 18, 2003

(65) Prior Publication Data

US 2004/0016398 A1 Jan. 29, 2004

Related U.S. Application Data

(62) Division of application No. 09/869,736, filed as application No. PCT/CH00/00025 on Jan. 18, 2000, now Pat. No. 6,649,209.

(30) Foreign Application Priority Data

Jan. 22, 1999 (CH) ..... 118/99

(51) Int. Cl.
*B05C 1/02* (2006.01)

(52) U.S. Cl. ..... 118/58; 118/215; 118/254; 118/DIG. 3

(58) Field of Classification Search ..... 118/16, 118/58, 214, 215, 254, 318, 319, 322, 324, 118/DIG. 3, 317; 427/239, 424, 429, 314; 53/249; 198/861.1, 468.8, 346.3
See application file for complete search history.

(56) References Cited

U.S. PATENT DOCUMENTS

| | | | | |
|---|---|---|---|---|
| 1,772,318 A | | 8/1930 | Lontke | |
| 3,551,184 A | | 12/1970 | Dremann et al. | |
| 3,708,376 A | * | 1/1973 | Mistarz et al. | 156/580 |
| 3,965,854 A | * | 6/1976 | Scheiber | 118/66 |
| 4,018,952 A | * | 4/1977 | Brigham et al. | 427/425 |
| 4,198,166 A | * | 4/1980 | Tuns | 366/112 |
| 4,259,372 A | * | 3/1981 | Eddy | 427/236 |
| 4,505,220 A | * | 3/1985 | Bank et al. | 118/16 |
| 4,519,493 A | | 5/1985 | Dyer | |
| 4,842,887 A | * | 6/1989 | Bolte | 427/10 |
| 5,578,128 A | * | 11/1996 | Schneider | 118/696 |

FOREIGN PATENT DOCUMENTS

| | | |
|---|---|---|
| BE | 889.313 | 10/1981 |
| DE | 28 31 207 | 1/1980 |
| DE | 41 39 365 C1 | 11/1991 |
| DE | 44 11 680 C1 | 8/1995 |
| EP | 0 590 664 A2 | 4/1994 |
| EP | 0 676 256 A1 | 5/2000 |
| FR | 1.468.471 | 12/1966 |
| GB | 751863 | 7/1956 |
| JP | 62267481 | 11/1987 |

(Continued)

*Primary Examiner*—Laura Edwards
(74) *Attorney, Agent, or Firm*—McCormick, Paulding & Huber LLP

(57) ABSTRACT

The invention relates first of all to a method for covering areas of damaged protective coating on containers or the like, in which, according to the invention, protective coating material is stamped on to the zone in which the damaged areas occur. The invention also describes an apparatus for carrying out the method in which a carrier unit is provided for stamping protective coating material on to the damaged area. Apparatus is provided for positioning the carrier unit with respect to the container.

3 Claims, 7 Drawing Sheets

FOREIGN PATENT DOCUMENTS

| | | | |
|---|---|---|---|
| SU | 1015925 | * | 5/1983 |
| WO | WO 87/04957 A1 | | 8/1987 |
| WO | WO 93/14236 A1 | | 7/1993 |
| WO | WO 98/52750 | | 11/1998 |

* cited by examiner

METHOD AND APPARATUS FOR COVERING AREAS OF DAMAGED PROTECTIVE COATING, AND A TRANSPORT SYSTEM

CROSS REFERENCE TO RELATED APPLICATIONS

This application is a divisional of U.S. application Ser. No. 09/869,736, filed Jul. 3, 2001, now U.S. Pat. No. 6,649,209, which claims priority to International application Ser. No. PCT/CH00/00025, filed Jan. 18, 2000, which in turn claims priority to Swiss Patent Application No. 118/99, filed Jan. 22, 1999.

BACKGROUND OF THE INVENTION

1. Technical Field

The present invention relates to methods and apparatus for manufacturing metal containers in general, and to methods and apparatus for providing a protective coating to an area of the metal containers in particular.

2. Background Information

In the manufacture of metal containers such as small tubs of 0.5 liter to several liters capacity, lugs are provided on either side of the container body as anchor points for the carrying handle. These lugs are attached to the bodies preferably by welding or by some other method of fixing after the bodies have been resistance spot welded; this, however, means that the protective coating or covering applied to the sheet metal prior to fabrication of the containers is damaged and/or that bare metal is left exposed after the attachment process. These areas of damaged coating or bare metal then have to be given a protective coating to prevent corrosion by, or contamination of, the product contained. The invention can of course be applied to any situation where unprotected areas of the kind described above are to be covered with a coating for similar reasons.

In principle, methods which suggest themselves for covering the areas of damaged protective coating or of bare metal are those used to produce large areas of protective coatings on bare metal. In one such method, can seams are coated by a wet lacquering process in which a lacquer is applied to the surface to be coated. Disadvantages of this known method are the long drying times and the solvent vapors given off in the drying phase, necessitating the increasing use, for environmental reasons, of special extraction systems.

In another known method for covering welded can seams which have been exposed by the welding process, electrically charged coating powder is sprayed between lateral shields on to the weld seam, which is carried continuously past the spraying unit and is therefore "endless", while excess coating powder which accumulates in the shields is continuously extracted. The powder which has been sprayed on is then heated in heating lines, which can be up to 20 meters long, and is thereby cured. This known method, which is sometimes also used in the manufacture of welded tub bodies (to cover the exposed body seam) is, as has been said, continuous, that is to say endless, and is not suitable for treating small areas. Moreover, it is likely that the intact, already coated surface of the containers would be contaminated, which would necessitate subsequent cleaning, or heating of the entire internal surface of the container in order to bind the pulverulent coating material.

Lastly, there is the option of sticking a foil with protective coating material over the damaged areas. This known procedure utilizes an additional substance, namely an adhesive suited to the purpose, and this should be avoided if possible, to avoid further contamination and spoiling of the product contained. For containers intended to be filled with a food product, for example, this would mean that the foodstuff compatibility of the adhesive would have to be proved and/or approval obtained from such authorities as the FDA in the USA, which is a time-consuming and expensive process. In any event, the adhesive would still need to be pronounced completely safe for the individual product to be contained, not least in view of the shelf life of up to several years expected of metal packaging.

The amount of material absorbed in the process of restoring the covering layer is also relevant, as such containers may be manufactured in large numbers, with the result that the consumption of material (in addition to the capital costs) is a critical factor for the production line.

Accordingly the problem which lies at the basis of the present invention is to specify a method and an apparatus which are capable of performing the task with a minimum amount of additional coating material.

This problem is solved by a method for covering areas of damaged protective coating on containers or the like, characterized in that protective coating material is stamped on to the zone in which the areas to be coated occur. Advantageous configurations of the invention, an apparatus for carrying out the method and a transport system are indicated in further claims.

The invention has the following advantages. Because material is applied only in the region where bare or damaged areas occur, and there is no longer any need for surplus powder to be removed, it becomes possible to cover such areas at small cost in terms of coating material. Furthermore, there is no contamination of the container and no giving off of noxious solvent vapors, as it is possible to work with materials that are already recognized and accepted as appropriate, notwithstanding the fact that the methods used hitherto in the can industry (where lugs may be unknown) basically cannot be applied to the solution of the present problem.

These and other objects, features and advantages of the present invention will become apparent in light of the detailed description of the invention, and the accompanying drawings.

BRIEF DESCRIPTION OF THE DRAWINGS

The invention will now be described in detail with reference to drawings by way of example, in which.

DETAILED DESCRIPTION OF THE INVENTION

Figure 1:
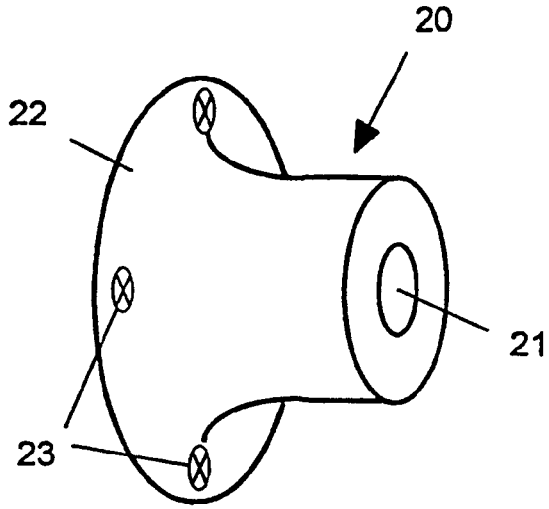
FIG. 1 is a perspective view of a lug for welding on to the body of a container.

FIG. 1 shows a lug 20 which essentially consists of a cylindrical body which has a cover with a hole 21 at one end and a foot 22 extending away from the longitudinal axis of the body at the other end. Weld points, formed e.g. by the spot welding process, are indicated at 23.

Figure 2A:
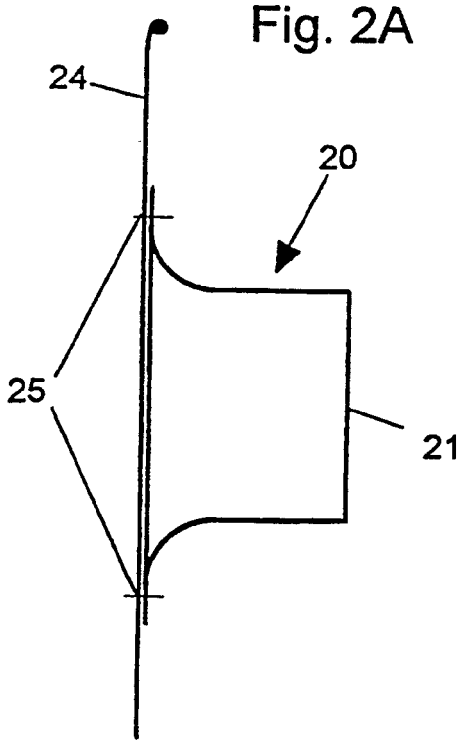
FIGS. 2A and 2B show the lug after welding, in a section perpendicular to the body and also in an end view.
Figure 2B:
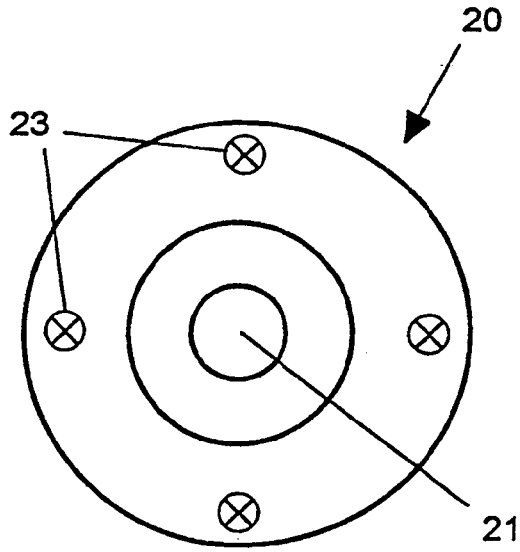

FIG. 2A shows the body 24 of a container to which a lug 20 according to FIG. 1 has been attached. The welding process has left areas of damaged protective coating, indicated at 25, on the inside of the container. These damaged areas 25 correspond to the weld points on the foot 22 of the lug 20, and preferably lie in a circle, spaced apart at regular intervals, as shown in FIG. 2B. The problem of the invention is to repair the areas of damaged protective coating so that corrosion of the tub wall, and contamination of the product contained, cannot occur.

Two lugs 20 are provided on each container, and are located opposite each other on the outside of the container in the region of the container's upper rim. A carrying handle can be joined in a known manner to the lugs 20, and thus to the container, by the hole 21. The invention is of course not limited to the attachment of lugs of this type, and can be adopted in any situation where a connection has to be made with other parts, such as tear-off tabs or similar, leaving areas needing to be covered with a protective layer.

Figure 3:
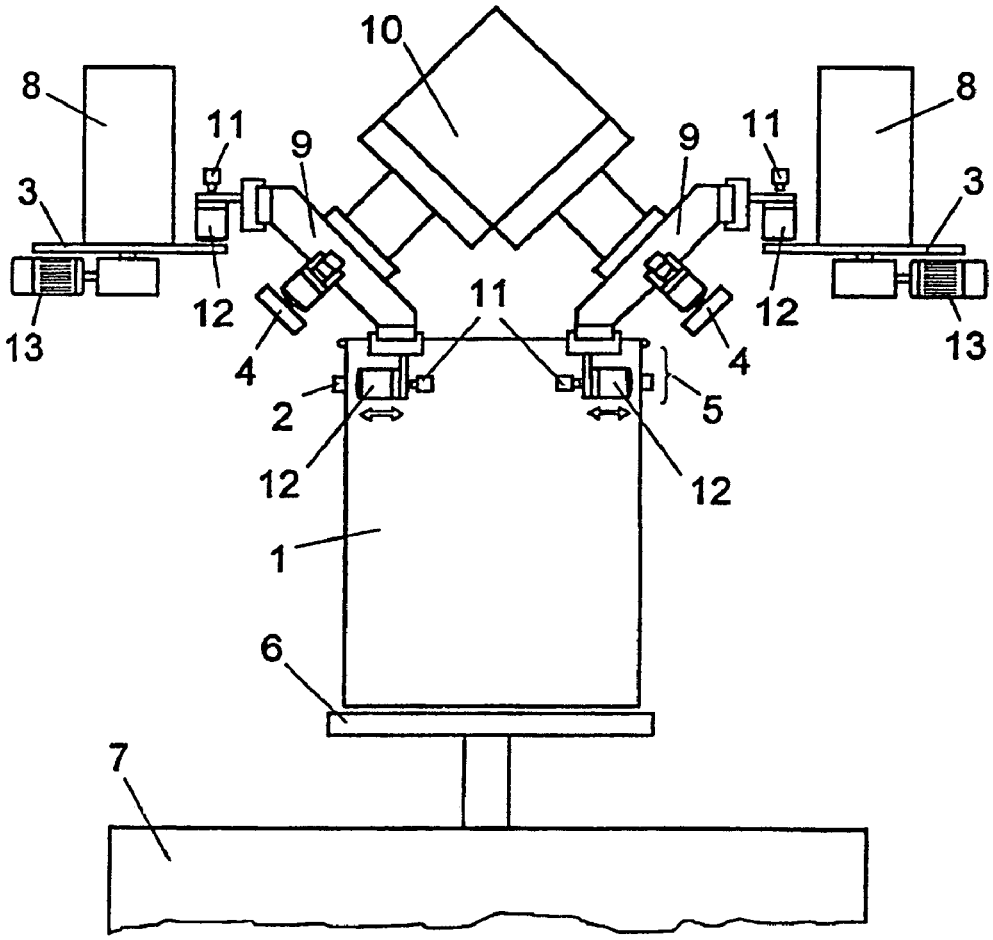
FIG. 3 shows an apparatus according to the invention for covering areas of damaged protective coating on a container.

FIG. 3 shows one embodiment of apparatus according to the invention for coating areas of damaged protective coating located on the inside of a container 1 which has been provided with lugs 2. In one way of carrying out the invention, the damaged areas are coated by stamping pulverulent coating material on to the zone susceptible to damage. Pulverulent coating material is applied by means of a carrier unit 12, preferably a so-called "stamp pad", which is pressed on to the affected area by means of a pusher unit 11, causing coating material to be transferred on to the body of the container 1. Transfer of coating material is assisted if the temperature of the container 1, and/or of the region to which the coating powder is to be applied, is higher than that of the carrier unit 12. A heating element 4, which will be described presently, is provided for this purpose.

After every stamping of coating powder on to the zones subject to damage, the carrier unit 12 has to be recharged with powder. This is done by means of a rotatably mounted transfer unit 9 which is driven by an angular gear 10 and which preferably has a number of carrier units 12 with corresponding pusher units 11 arranged on it. Then, one carrier unit 12 can be picking up coating material while another carrier unit 12 is stamping coating material on to the container 1. Yet another carrier unit 12 can be preheated during the same time interval by means of the above-mentioned heating element 4 in order that, in the ensuing step, it will be able to pick up coating material which has been prepared on a turntable 3 in a manner which will be described presently, the carrier unit 12 again being actuated by means of the corresponding pusher unit 11 to effect such pick-up of material.

As can be seen from FIG. 3, with optimum handling it is possible for the damaged areas 25 of both lugs 2 welded to the same container 1 to be provided with coating material. To accomplish this, an additional transfer unit 9 of similar construction to the one which has been described, and preferably driven by the same angular gear 10, is provided. This means that perfectly synchronized coating of the damaged areas at the two lugs 2 is assured, or in other words that the two symmetrically arranged transfer units 9 work in unison on either side of the container 1. Each transfer unit is rotatably mounted and holds four carrier units 12 i.e. stamps made of silicone. The carrier units 12 are displaced axially by the corresponding pusher unit 11 at every working step. In a first step, the carrier unit 12 is pressed on to the heating element 4 and preheated so that in the next step it will be able to pick up the prepared coating powder from the turntable 3 as a result of light adhesion due to heating. In the next step, the carrier unit 12 with the powder adhering to it is lightly vacuumed to remove any loose powder particles. This results in greater cleanliness in the container 1. In the final step, the carrier unit 12 with the coating powder adhering to it is stamped on to the damaged areas.

To avoid having to move the angular gear 10 and the two transfer units 9 up and down, the containers 1 to be coated can be raised by means of an elevating platform 6 to enable the carrier units 12 to stamp coating powder on to the damaged areas.

As has already been mentioned, the pulverulent coating material to be stamped on to the damaged areas is removed from the rotatably mounted turntable 3 by the carrier unit 12 concerned. This turntable 3 forms part of a batching unit 31 which also has other components and which will now be further described with reference to FIG. 4.

Figure 4:
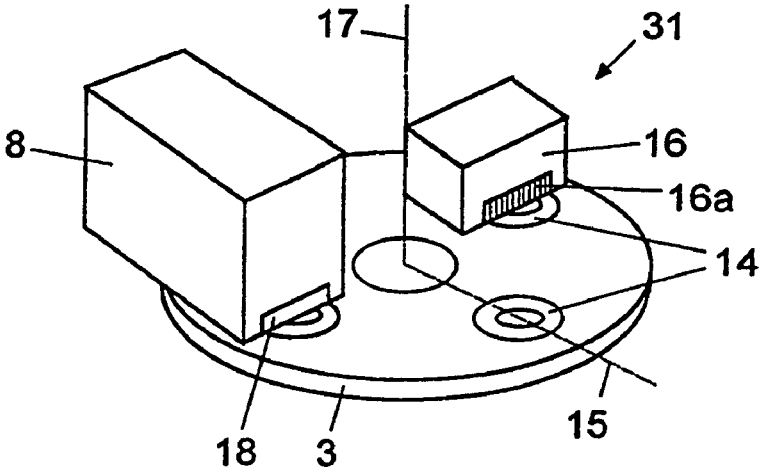
FIG. 4 is a perspective view of a batching unit used in the apparatus according to FIG. 3.

FIG. 4 shows the batching unit 31 in a perspective view. In addition to the preferably horizontal turntable 3, which has recesses 14 that are about to be explained and which is preferably rotatable about a vertical axis 17 and capable of being driven in such rotation by a drive unit 13 (FIG. 3), a bin 8 for pulverulent coating material and a cleaning unit 16 are provided.

The recesses 14 are filled with coating powder, which runs out from the bottom of the bin 8, up to the level of the top of the turntable 3. For this purpose a wiper 18, for example in the form of a strip, is provided behind the bin 8, viewed in the direction of rotation of the turntable 3. In FIG. 4, the reference numeral 15 denotes the transfer position in which a carrier unit 12 (FIG. 3) picks up as nearly as possible all the coating material contained in the recess 14.

Transfer is assisted by heating the carrier unit 12 concerned, or the surface thereof, by means of the heating element 4 before pick-up takes place.

After the coating powder is picked up, the turntable 3 goes on turning. When it reaches the cleaning unit 16, at the entry to which a brush 16*a* is provided, any coating material remaining in the recess 14 is removed.

The configuration of the recesses 14, and hence of the coating patches actually applied, is such that consumption of coating material can be kept to a minimum and yet is sufficient to ensure that the damaged areas—together with a certain margin—are reliably covered. Moreover, the thickness of the coating applied is set by the depth of the recesses 14.

In keeping with the arrangement of weld points assumed here and in view of the criteria mentioned above, the chosen form for the recesses 14 is that of a ring.

Figure 5:
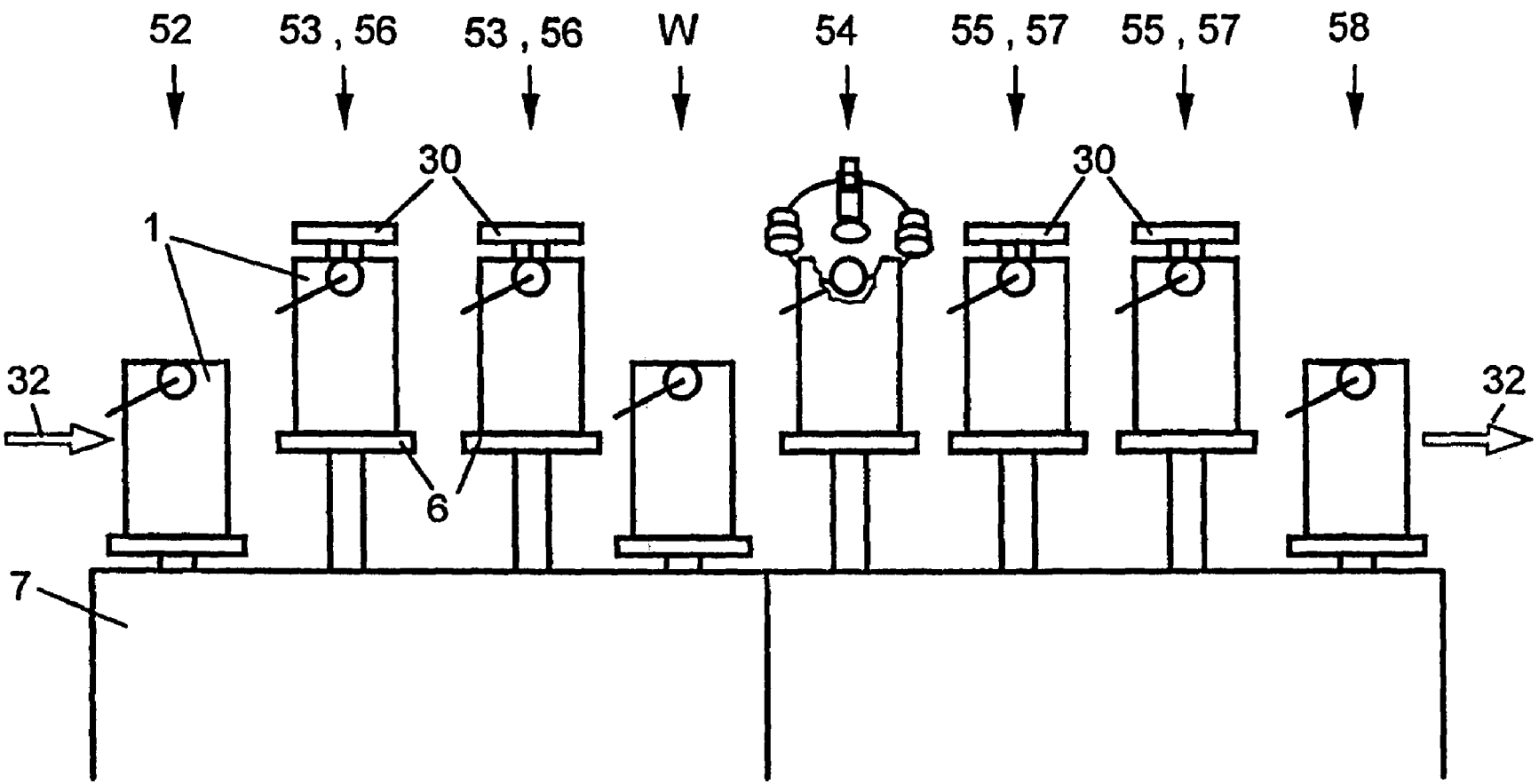
FIG. 5 represents schematically individual phases of a transport system according to the invention.

The method of handling the containers 1 is shown schematically in FIG. 5, in which individual process steps, each corresponding to one segment of cycle time, are numbered 52 to 58. The same steps and numbers also appear in FIG. 6.

Referring to FIG. 5, a container 1, which has already been provided with a bottom, lugs 2, and a handle, is transferred to the coating unit 7, that is to say it is initially placed in position 52. Here the lugs 2 are aligned to ensure that the coating material will be stamped in the right place. By a pendulum step process which will be described presently, the containers 1 are individually transported to the next position 53, 56 in order that the target zones can be heated with a heating unit 30, designed as an induction heater, hot air blower, or infra-red radiator. For a more homogeneous contact with the powder adhering to the transfer unit 12, the container 1 is preferably heated from the inside. In one embodiment of the invention, the containers 1 are lifted vertically by means of an elevating platform 6, to avoid having to move the heating units 30. Hot air or infrared radiation can be brought to bear from both sides, and can be used simultaneously if desired. The container 1—if need be after pausing in a waiting position W—is then transferred to position 54, where coating material in powder form is applied, preferably in the manner described with reference to FIGS. 3 and 4. Here again the container 1 is raised, to avoid having to move the batching unit 31 and transfer units 9 together with their angular gear 10 (FIG. 3). Finally, in position 55, 57, heating again takes place: by means of heating units 30, the temperature of at least the zones subject to damage is raised, preferably to the melting point of tin. Depending on the melting point of the protective coating material employed, the requisite temperatures will lie e.g. between 150 and 240° Celsius.

Figure 6:
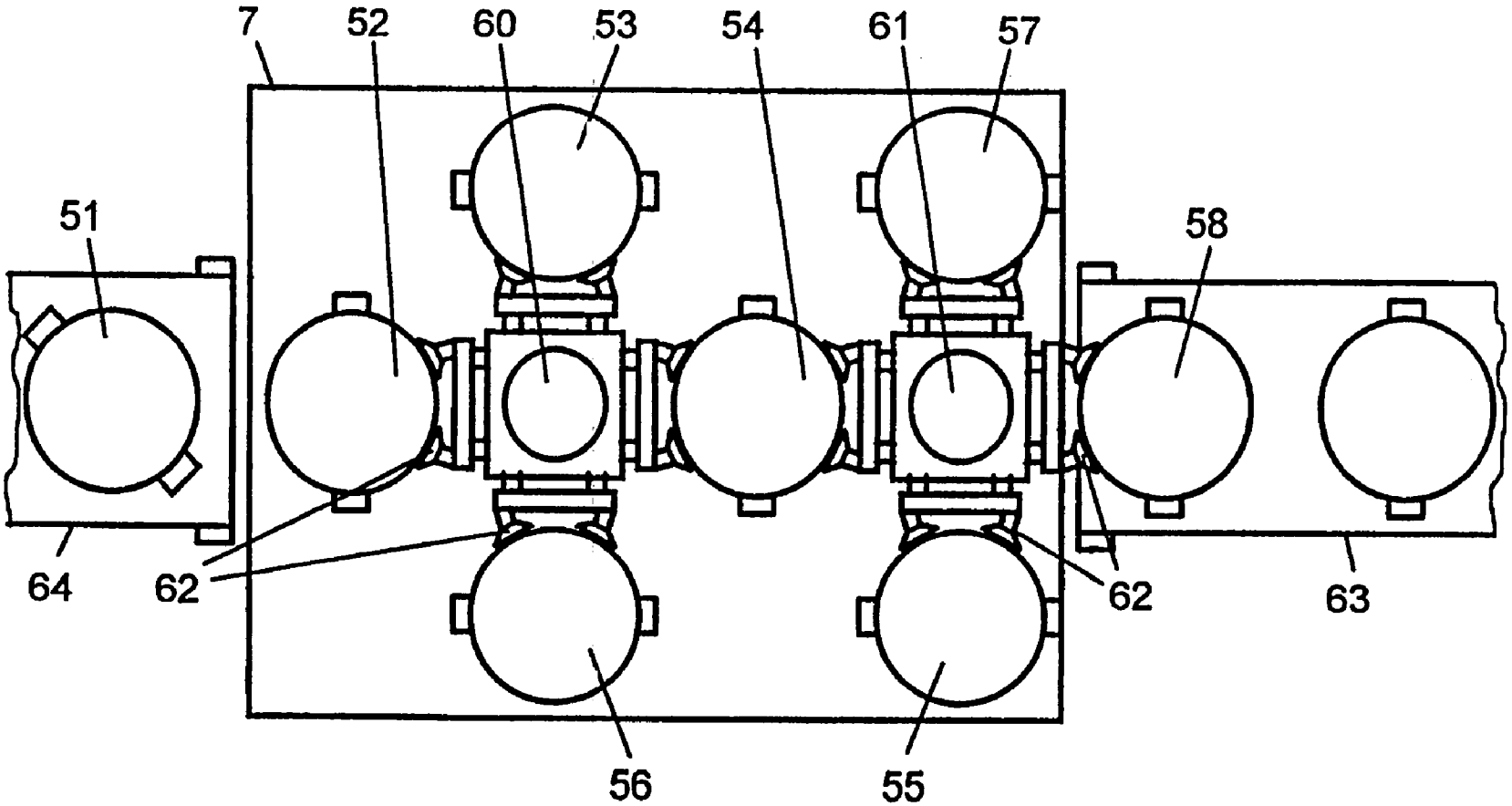
FIG. 6 is a view from above of one embodiment of the transport system according to FIG. 5, with two rotary manipulators.

FIG. 6 shows a transport system according to the invention in which the positions 52 to 58 which have been described with reference to FIG. 5 are realized in an arrangement that is compact and allows for rigidly imposed transport cycle times. The application of coating takes place in a production line for the containers concerned which may extend from the cutting-up of sheet-metal blanks to form the containers to the filling and closure of the containers, so that the transport cycle is preordained. With the aid of a rotary manipulator 60 the containers 1 can be preheated in tandem, one being heated while the other is being transported and vice versa.

To heat a container, the container is transferred, by means of suction cups 62 or the like forming part of the rotary manipulator 60, from position 52 to position 53, where it is parked. In the next step of the cycle, the next container arriving in position 52 is picked up and transferred to position 56. During this transfer phase, the container parked in position 53 stays where it is. Not until a container has been parked in position 56 is the container in position 53 picked up again, and transferred by rotation of the manipulator 60 to position 54, where for example the stamping-on of coating powder as described with reference to FIGS. 3 and 4 takes place. The second rotary manipulator 61 is used in a similar way.

In this way, the heating phase is extended without affecting the fundamental cycle time. If baking is necessary following application of the coating powder, a second rotary manipulator 61, connected in series, will be required, again giving the heating unit 30 (FIG. 5) an extended dwell time.

The method according to the invention and the transport system according to the invention are particularly suited for mechanized and continuous operation in a production line, as has already been stated. Over 80 cycles per minute can be achieved. Consumption costs can be kept to a minimum by the precise nature of the batching. With the method according to the invention, contamination of the container with loose powder does not occur, as any loose powder will stay stuck to the carrier units.

In another embodiment of the invention, instead of using stamping pads as carrier units these are formed as a solid bar of protective coating material. Shortly before being stamped on to the damaged areas, the bar end is melted and/or the target zones are preheated to a temperature above the melting point of the coating material. This involves only minor modifications of the apparatus according to the invention. For instance the batching unit in the form described is no longer required. But the essence of the inventive idea still remains.

In one embodiment of the apparatus according to the invention, a foil tape which is cut up into blanks is used instead of powder. These blanks are then picked up by the transfer unit and applied to the inner wall of the container in the same way as a prepared ring of powder. The apparatus can remain essentially unchanged, the only difference being that the bin 8 will then be dispensing foil blanks instead of powder on to the turntable 3. An expert will be capable of making the necessary modifications without needing further instruction.

A preferred embodiment of an apparatus for applying blanks will be described with reference to FIGS. 7 to 10.

Figure 7:
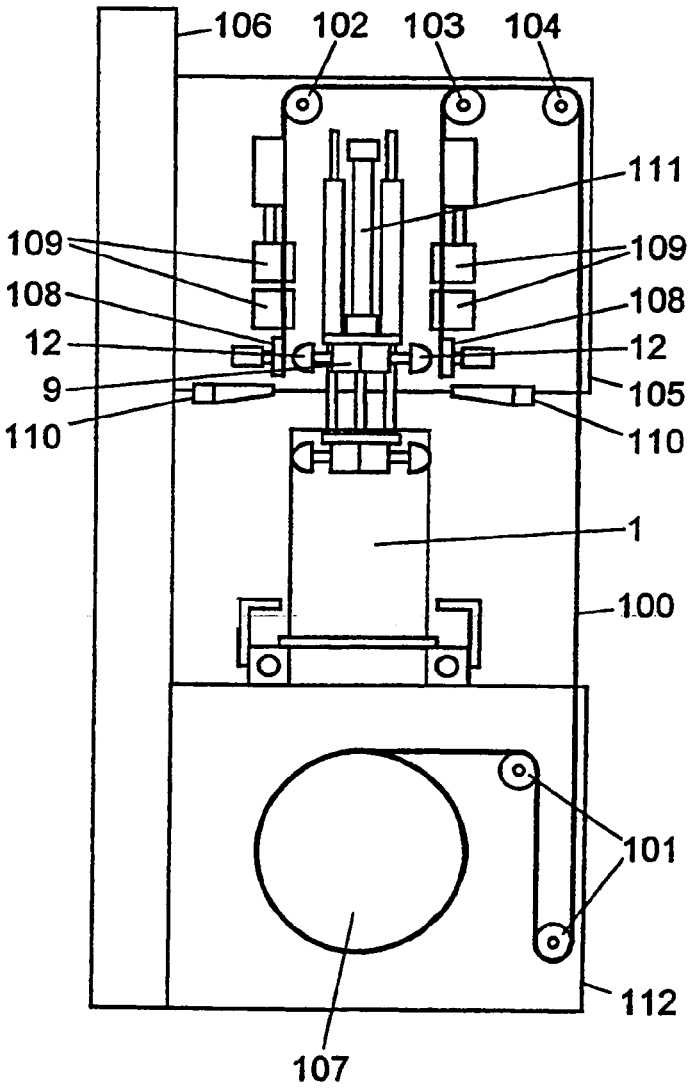
FIG. 7 shows a further embodiment of the apparatus according to the invention for covering areas of damaged protective coating with foil.

FIG. 7 shows the preferred embodiment of the invention in a partly cutaway view perpendicularly to the transport direction of the containers 1. The containers 1 are transported in a series of steps; before the application of foil (and if a heating device—which will be explained later (FIG. 9)—is used, before reaching the heating device), the containers 1 are aligned so that the point of application is in register with the position of the lugs 2. Preferably, the containers 1 are aligned so that the lugs 2 are located laterally when viewed in the transport direction.

Foil 100 is supplied from a reel 107 located in a hot box 112 under the transport system for the containers 1. In the case of the apparatus illustrated in FIG. 7, the foil tape 100 is double-wound on the reel 107. This makes it possible by means of suitable deflection pulleys 102 to 104 to convey the foil 100 to the transfer unit in a simple manner, as follows: the foil tape is fed by means of a tape feed unit and tape holder 109 which are operated alternately, and the foil 100 is cut into the desired shapes by means of a punch 108 and transferred to the transfer unit 9 fitted with carrier units 12. Here the carrier units 12 preferably consist of so-called "stamp pads" which pick up the foil blanks by suction. These stamp pads have holes at suitable points which communicate with a chamber connected in turn to a low-power vacuum pump.

In FIG. 7 the transfer unit 9 has been drawn in two positions. In the upper position, the carrier unit 12 is charged with a blank of foil material. A container 1 with areas of damaged protective coating in the region of the lugs 2 has been prepared and placed in position underneath the transfer unit 9. The transfer unit 9 is then moved to the second, i.e. lower, position by means of a pneumatic or hydraulic cylinder 111. A further, horizontally mounted cylinder presses the carrier units 12 charged with blanks radially outwards at the same level as the lugs 2, so that the blanks are applied to the areas of damaged protective coating. Prior to the application of the blanks, the container 1 is heated, in a manner which will be described presently, to a temperature affording ideal conditions for joining the foil material to the interior of the container.

Polyamide-12 (also known under the trade name NYLON), polyamide-6 and polyester have all proved suitable as foil material, especially polyamide-12. In the case of the last mentioned product, the containers 1 and/or their interiors in the region of the lugs 2 are preferably heated to a temperature of approx. 160° Celsius. This ensures perfect bonding of the foil material to the inner wall of the container.

At the same time, the hot box 112 containing the reel 107 of foil tape is heated to a temperature of approx. 80° Celsius. This prepares the foil material for the application process. Any water droplets which may have been deposited on the tape are evaporated by this warming process before the foil is applied. This will effectively prevent flaking.

Figure 8A:
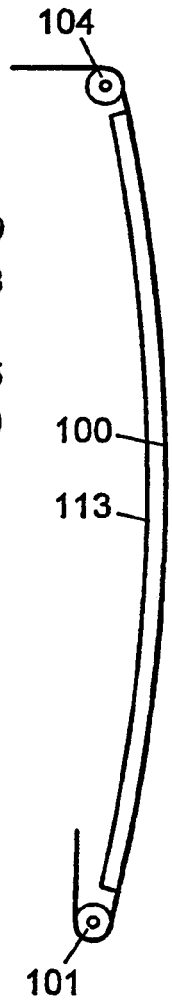
FIGS. 8A and 8B show different variants of a foil heating unit required in the apparatus according to FIG. 7.

In a further embodiment of the apparatus according to the invention, shown in FIG. 8A, a skid 113 is substituted for the hot box 112. The foil tape is guided along this skid 113, which is heated to approximately 100° Celsius. This again prevents water droplets from being deposited on the foil tape, and evaporates any water droplets which may be present.

Figure 8B:
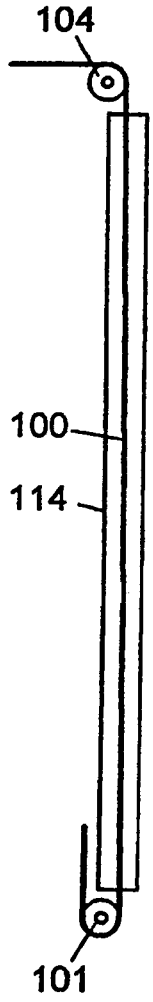

FIG. 8B shows an alternative embodiment to the skid 113 shown in FIG. 8A. The foil tape is guided through a hot-air tunnel 114 which performs the functions stated above.

Figure 9:
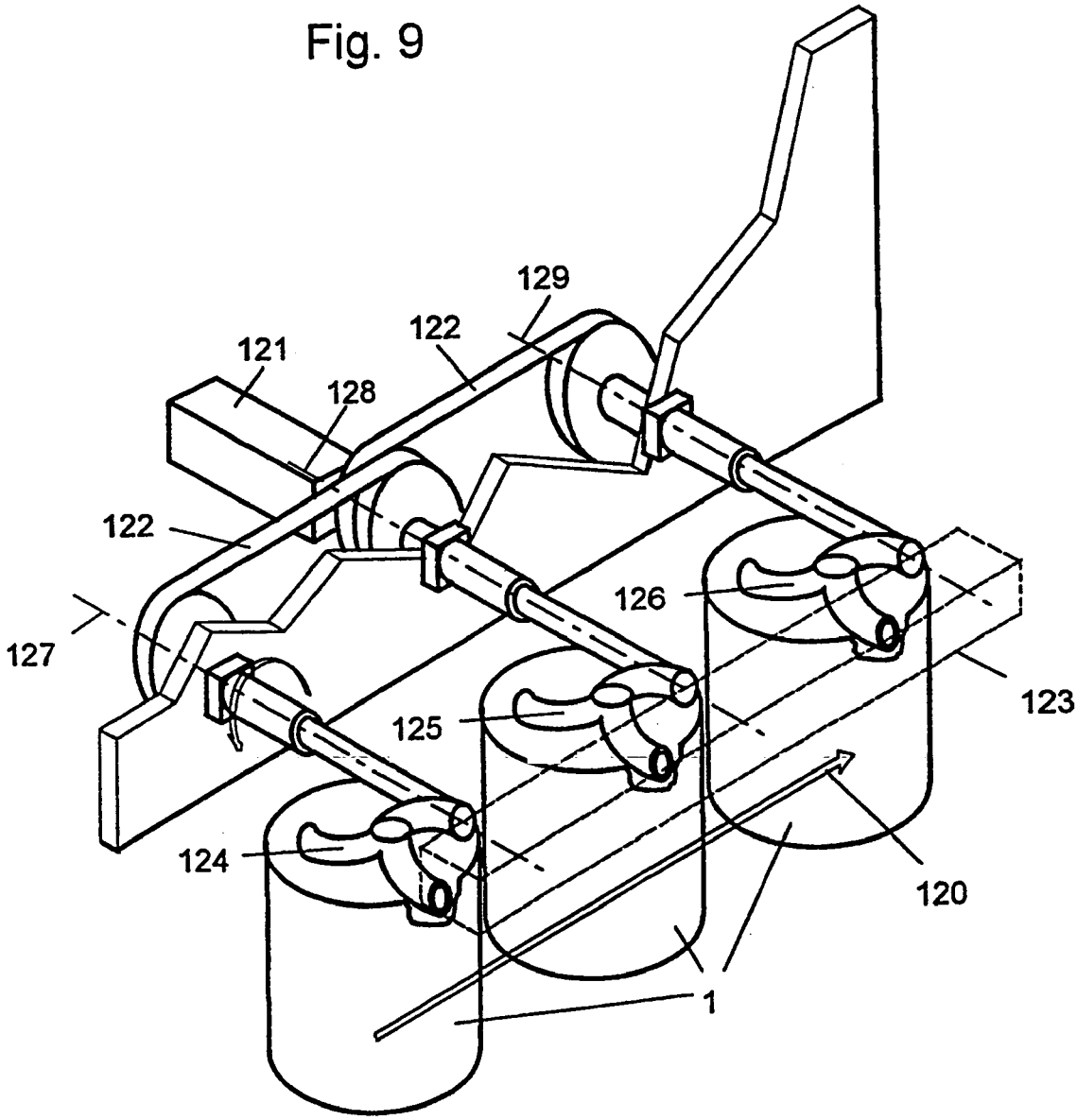
FIG. 9 shows a heating device for heating containers during several working steps.

FIG. 9 shows an arrangement for three-stage heating of the areas of damaged coating on the interior of the containers 1, which are advanced in steps in the direction of the arrow 120 by means of a transport system (not shown in FIG. 9). During the stages when the containers are at rest, hot air supply lines 124, 125, 126 are positioned in the open topped containers over the damaged areas. In synchronization with the advance of the containers 1 in the direction 120, a drive unit 121 is triggered so that the supply lines 124, 125, 126 do not come into contact with the containers 1. The drive unit 121 is coupled with the heat supply lines 124, 125, 126 by drive belts 122 and swiveling axes 127, 128, 129. The heat supply lines 124, 125, 126 are supplied with hot air via a heating air duct 123, in which they are pivotally mounted.

With the proposed heating device, there is no need to vary the transport cycle for the containers 1 even if the heating operation has to be performed in a number of cycles. Also, the amount of movement of the heating assemblies is minimal.

Figure 10A:
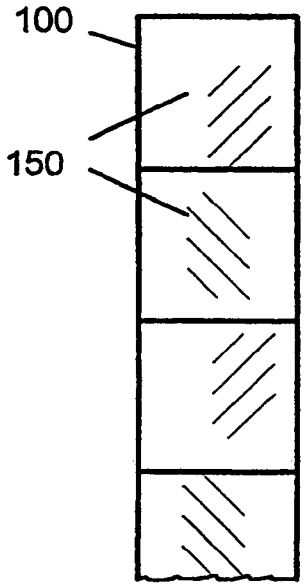
FIGS. 10A, 10B, and 10C show various blanks cut from foil tapes.
Figure 10B:
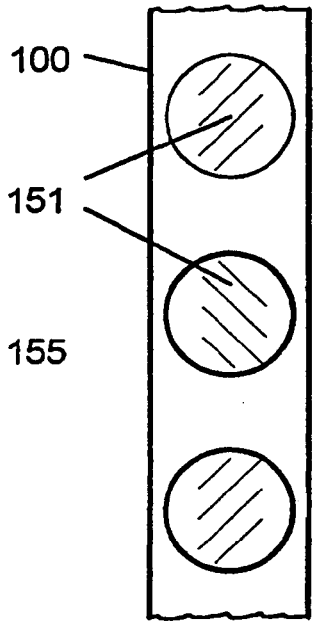
Figure 10C:
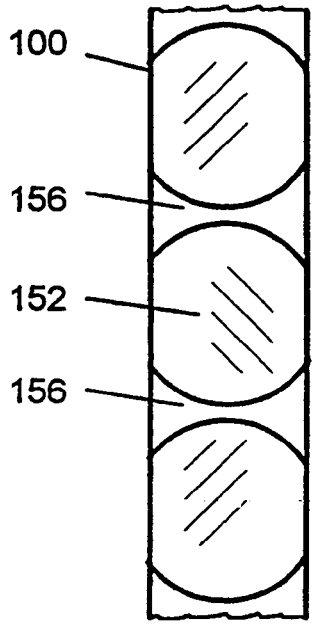

FIGS. 10A–10C show some foil tapes 100 and blanks 150, 151, 152 taken therefrom. For example, FIG. 10A shows rectangular blanks 150 which can be made without leaving any waste.

In FIG. 10B, round blanks 151 are produced by means of a punch 108 (FIG. 7A). A strip of waste 155 is left over.

Lastly, FIG. 10C shows the preferred type of blank. By means of the punch 108 (FIG. 7A), blanks 152 are produced that are circular except for two straight segments. The intermediate pieces 156 that are left over as waste are extracted by means of an extraction device 110.

The invention can be used to advantage in other applications besides the covering of areas of damaged protective coating on containers. The invention is highly suitable for covering areas on components of any description.

Although this invention has been shown and described with respect to the detailed embodiments thereof, it will be understood by those skilled in the art that various changes in form and detail thereof may be made without departing from the spirit and the scope of the invention.

The invention claimed is:

1. A system for coating containers, comprising an apparatus for coating an area of damaged protective coating on a container, the apparatus including a heater and a carrier unit;

a first conveyor having a plurality of platforms, wherein each platform is selectively actuable to position a container at a first station proximate the heater for heating the area of damaged protective coating on the container; and a second conveyor having a plurality of platforms and being configured for receiving containers from the first conveyor, wherein each platform is selectively actuable to position a container at a second station proximate the carrier unit for depositing protective coating material attached to the carrier unit onto the area of damaged protective coating on the container that was heated at the first station.

2. A system for coating containers, comprising an apparatus for coating an area of damaged protective coating on a container, the apparatus including a carrier unit;

a rotary manipulator;

at least one heating unit separate of and spaced from the apparatus for coating, the at least one heating unit being positioned adjacent the rotary manipulator;

a first conveyor, for supplying containers to the rotary manipulator;

wherein the apparatus is configured to rotate the carrier unit to a first station proximate to the at least one heating unit for heating the carrier unit prior to the carrier unit receiving a coating material, to a second station for the carrier unit to receive the coating material, and to a third station for the carrier unit to coat an area of damaged protective coating on a container; and a second conveyor for removing containers from the rotary manipulator.

3. A system for coating containers, comprising an apparatus for coating a limited area on a container, the apparatus including a heater and a carrier unit;

a first conveyor having a plurality of platforms, wherein each platform is selectively actuable to position a container at a first station proximate the heater for heating the limited area on the container; and a second conveyor having a plurality of platforms and being configured for receiving containers from the first conveyor, wherein each platform is selectively actuable to position a container at a second station proximate the carrier unit for depositing protective coating material attached to the carrier unit onto the limited area on the container that was heated at the first station.

* * * * *